US010174726B2

(12) United States Patent
Kusuda

(10) Patent No.: US 10,174,726 B2
(45) Date of Patent: Jan. 8, 2019

(54) INTAKE MANIFOLD

(71) Applicant: AISAN KOGYO KABUSHIKI KAISHA, Obu-shi, Aichi-ken (JP)

(72) Inventor: Kenji Kusuda, Tokai (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 15/604,015

(22) Filed: May 24, 2017

(65) Prior Publication Data

US 2017/0356405 A1 Dec. 14, 2017

(30) Foreign Application Priority Data

Jun. 14, 2016 (JP) ..... 2016-117871

(51) Int. Cl.
*F02M 35/10* (2006.01)
*F02M 35/104* (2006.01)

(52) U.S. Cl.
CPC .... *F02M 35/10222* (2013.01); *F02M 35/104* (2013.01); *F02M 35/10039* (2013.01)

(58) Field of Classification Search
CPC ..... F02M 35/10222; F02M 35/104; F02M 35/10039
See application file for complete search history.

(56) References Cited

U.S. PATENT DOCUMENTS

2006/0191505 A1 8/2006 Doko et al.
2013/0125851 A1* 5/2013 Miyashita ..... F02M 35/104 123/184.21
2014/0014056 A1* 1/2014 Sato ..... F02M 35/10072 123/184.47
2014/0102429 A1* 4/2014 Hayman ..... F02M 35/10222 123/568.18

FOREIGN PATENT DOCUMENTS

JP 4452201 B2 4/2010
JP 2014-43787 A 3/2014
JP 5828705 B2 12/2015

* cited by examiner

*Primary Examiner* — Jacob Amick
*Assistant Examiner* — Charles Brauch
(74) *Attorney, Agent, or Firm* — Oliff PLC

(57) ABSTRACT

An intake manifold is provided with a surge tank and a plurality of branch pipes branching from the surge tank, and is made up of a plurality of separate pieces. Each of the branch pipes is provided with an intake outlet for outflow of intake air to each cylinder of an engine. The intake manifold further includes a single gas inflow port, a plurality of gas outflow ports opening one in each of the branch pipes, and a gas passage extending in a branch form from the gas inflow port to each of the gas outflow ports. Each of the gas outflow ports is located away from the intake outlet of the corresponding branch pipe by a predetermined passage length.

11 Claims, 20 Drawing Sheets

INTAKE MANIFOLD

CROSS-REFERENCE TO RELATED APPLICATIONS

This application is based upon and claims the benefit of priority from each of the prior Japanese Patent Application No. 2016-117871 filed on Jun. 14, 2016, the entire contents of which are incorporated herein by reference.

BACKGROUND

Technical Field

The present disclosure relates to an intake manifold for distributing intake air to each of cylinders of an engine and, more particularly, to an intake manifold provided with a gas passage to distribute auxiliary gas, such as PCV gas and EGR gas, to each of cylinders of an engine.

Related Art

As the above type of technique, conventionally, there has been known an intake manifold disclosed in for example Japanese Patent No. 4452201 ("Patent '201"). FIG. 21 is a side view of an intake manifold 41 of this Patent '201. As shown in FIG. 21, the intake manifold 41 is provided with a collecting pipe (a surge tank) 42, a plurality of branch pipes 43, and a projecting part 44. The projecting part 44 is provided with one pipe joint 45 including one gas inflow port (not shown). In the projecting part 44, there are provided gas outflow ports (not shown) opening one in each of the branch pipes and a gas passage 44a extending in a branch form from the gas inflow port to each of the gas outflow ports. The gas passage 44a has a tournament-type branch shape extending from the gas inflow port to each gas outflow port in order to make pressure loss equal between portions of the gas passage 44a, or paths extending from the gas inflow port to each gas outflow port. The surge tank 42, each branch pipe 43, the projecting part 44, and others are integrally made up of a plurality of resin pieces 41A, 41B, 41C, and 41D that are joined to each other. The projecting part 44 is located near an outlet flange 46 formed around intake outlets of the branch pipes 43 and protrudes obliquely upward from behind the branch pipes 43.

SUMMARY

Technical Problems

However, in the intake manifold 41 in the Patent '201, each gas outflow port of the gas passage 44a is arranged in the vicinity of the outlet flange 46 of the branch pipes 43 and thus each gas outflow port is placed close to an intake port of each cylinder of an engine. Therefore, the cylinders are likely to communicate with each other through the gas passage 44a, which may deteriorate the performance of the engine. Herein, to make the cylinders less likely to communicate with each other even when the gas passage is provided, a passage between from each gas outflow port to an intake outlet (the outlet flange 46) of each branch pipe 43 has to be designed to be long to some extent. Furthermore, the orientation of each gas outflow port will intersect a flow of intake air in each branch pipe 43. It is therefore difficult to allow the gas emerging from each gas outflow port to smoothly flow along or together with the flow of intake air in the branch pipe 43. Furthermore, since the projecting part 44 is located near the outlet flange 46, this projecting part 44 may cause restriction on placement for surrounding parts or components around the engine.

The present disclosure has been made in view of the circumstances to solve the above problems and has a purpose to provide an intake manifold configured to cause no deterioration in engine performance even when the intake manifold includes a gas passage for auxiliary gas that is communicated with each of branch pipes.

Means of Solving the Problem

To achieve the above purpose, one aspect of the present disclosure provides an intake manifold comprising: a surge tank; and a plurality of branch pipes each branching from the surge tank, the intake manifold being made up of a plurality of separate pieces, each of the branch pipes being provided with an intake outlet for outflow of intake air to each of intake ports of an engine, wherein the intake manifold further comprises: a single gas inflow port for inflow of auxiliary gas; a plurality of gas outflow ports opening one in each of the branch pipes; and a gas passage extending in a branch form from the gas inflow port to each of the gas outflow ports, and each of the gas outflow ports is provided away from the intake outlet of the corresponding branch pipe by a predetermined passage length.

According to the present disclosure, even when an intake manifold includes a gas passage for auxiliary gas that is communicated with each of branch pipes when the intake manifold is mounted in an engine, this intake manifold can make cylinders of the engine less likely to communicate with each other, thereby enhancing intake flow characteristics in each branch pipe and preventing deterioration in engine performance.

DETAILED DESCRIPTION OF THE EXEMPLARY EMBODIMENTS

First Embodiment

A detailed description of a first embodiment of an intake manifold embodying the present disclosure will now be given referring to the accompanying drawings.

Figure 1:
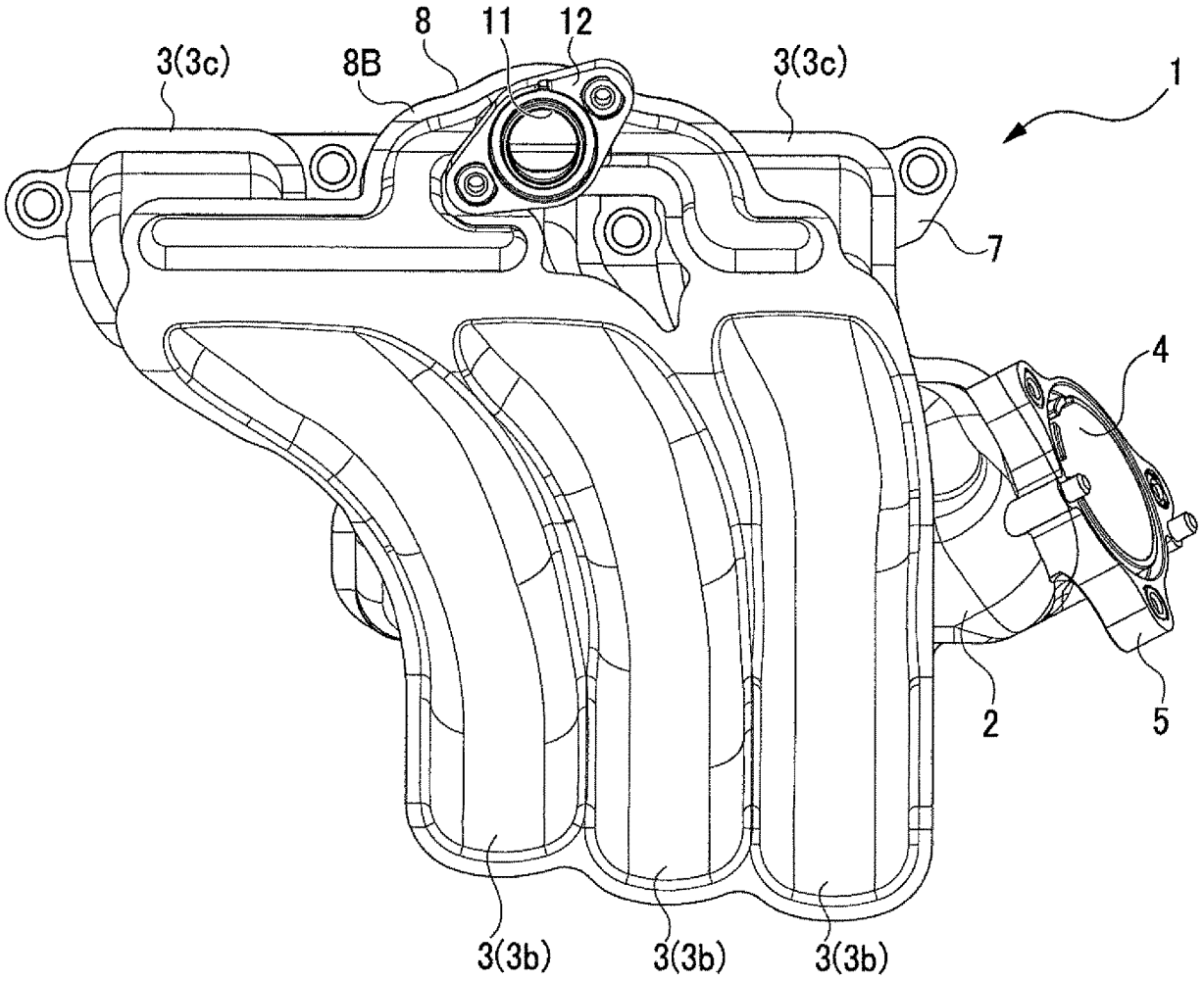
FIG. 1 is a front view of an intake manifold in a first embodiment.
Figure 2:
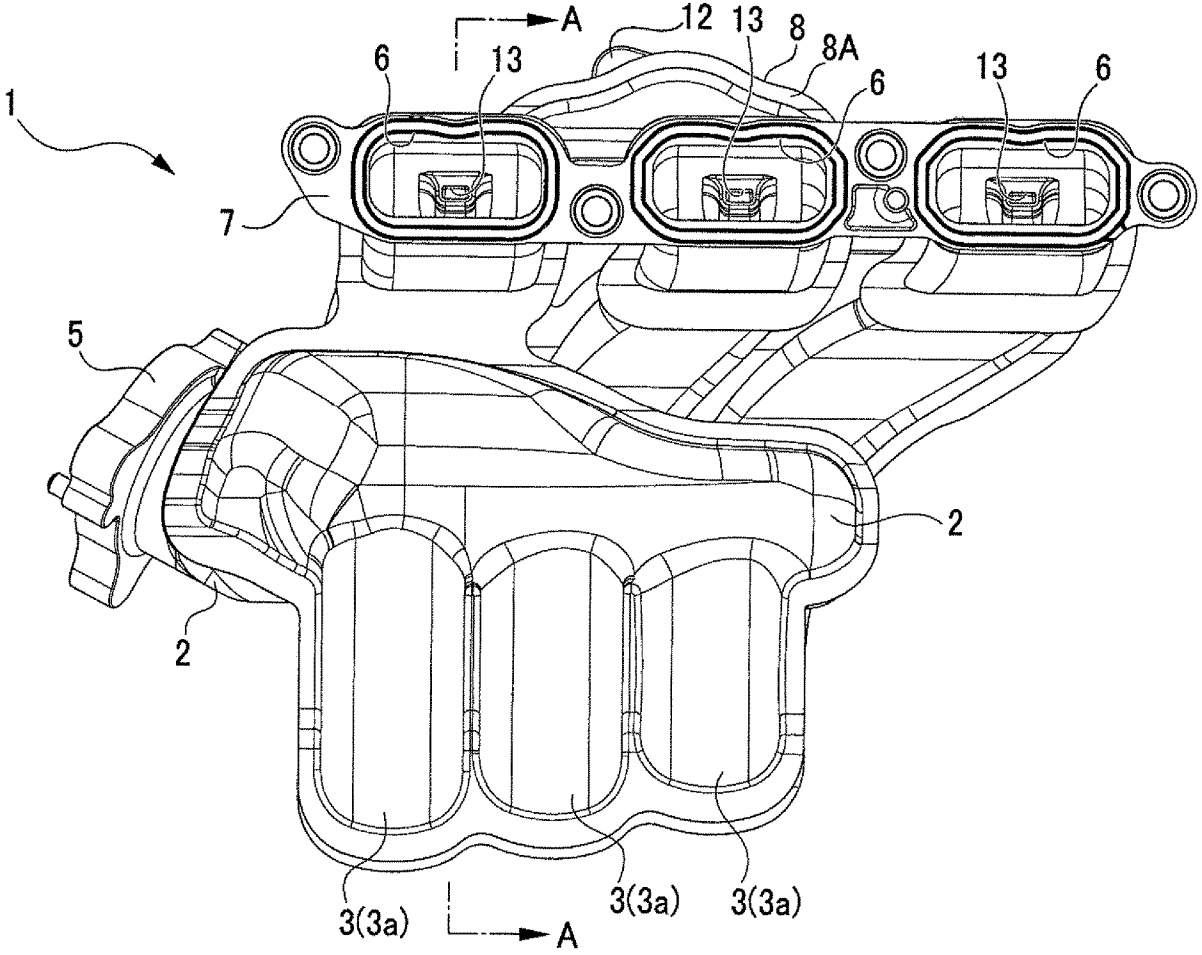
FIG. 2 is a back view of the intake manifold in the first embodiment.
Figure 3:
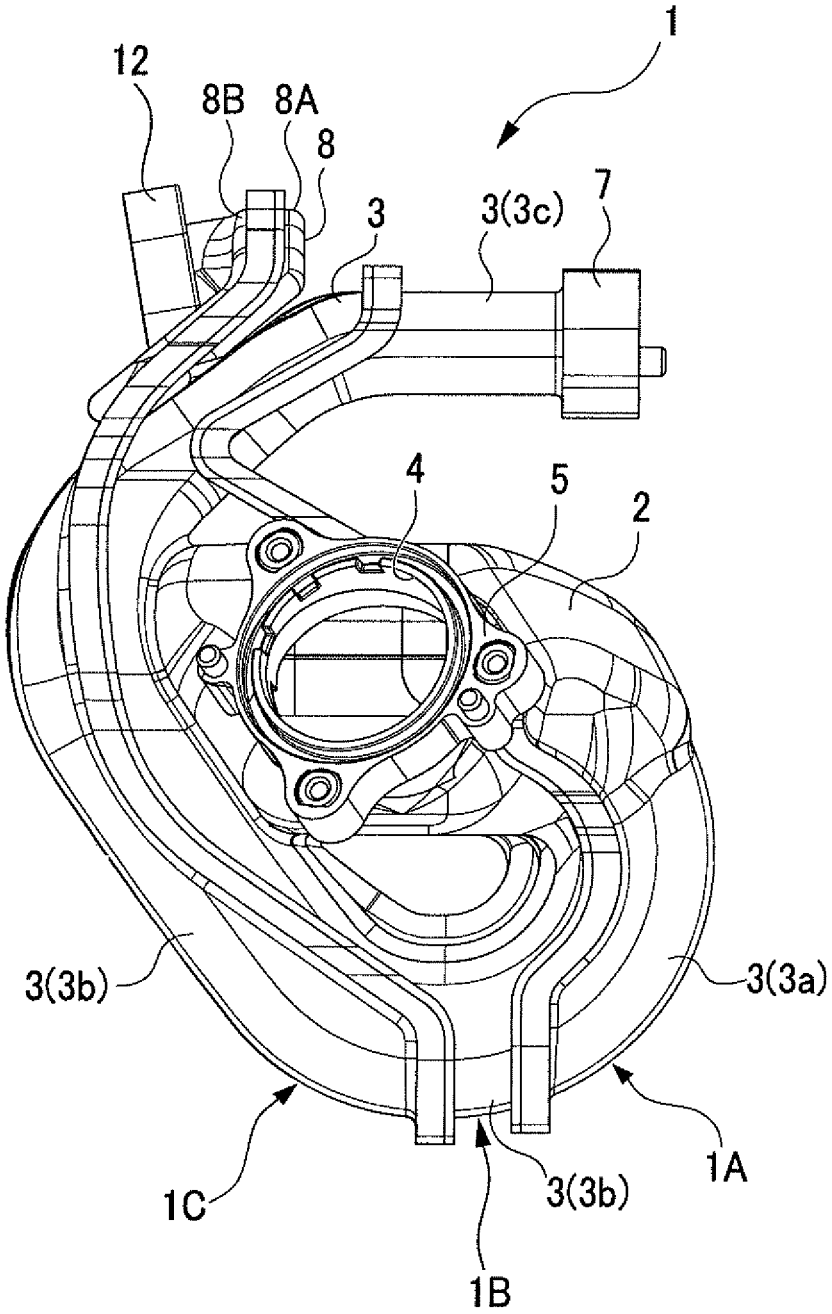
FIG. 3 is a right side view of the intake manifold in the first embodiment.
Figure 4:
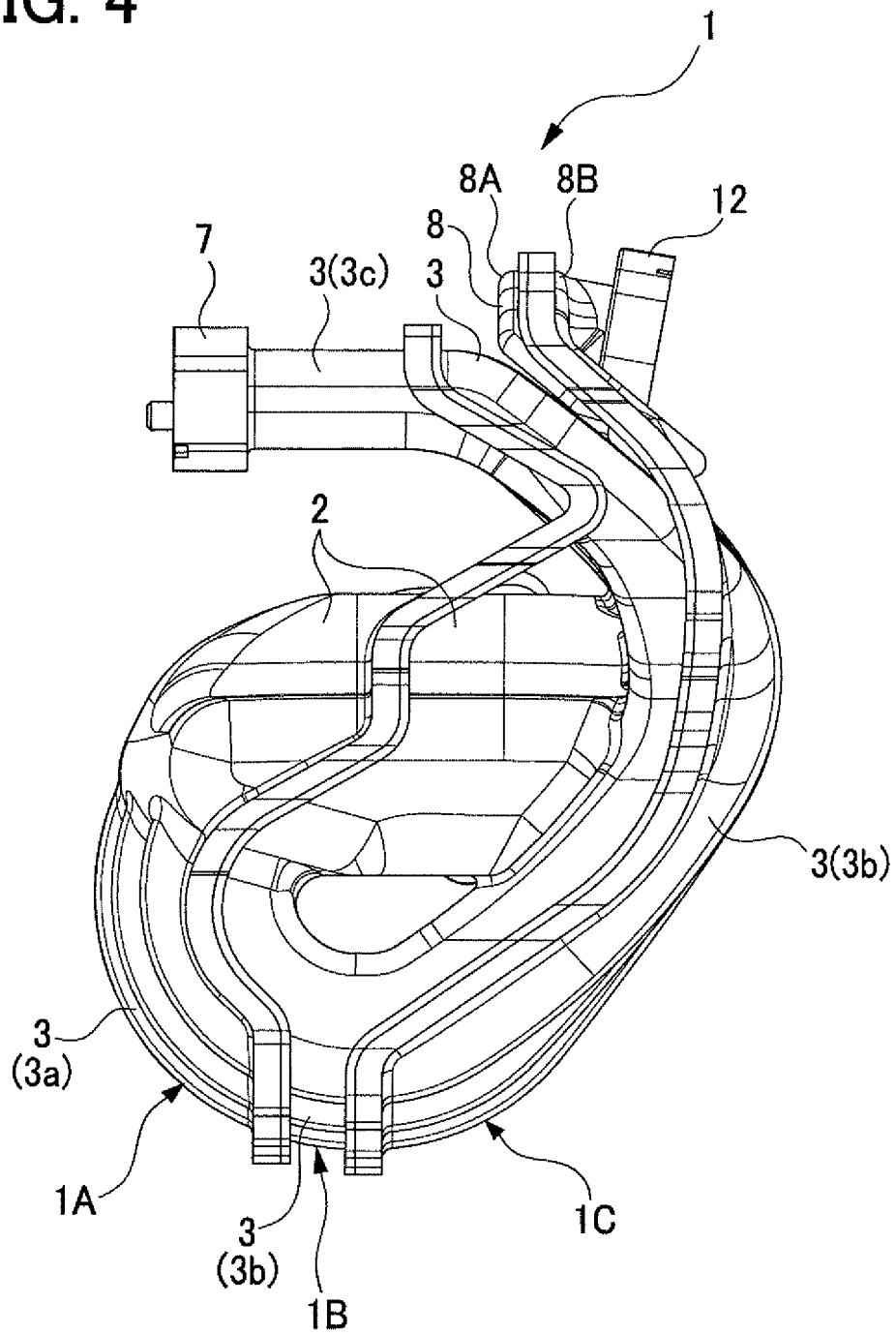
FIG. 4 is a left side view of the intake manifold in the first embodiment.
Figure 5:
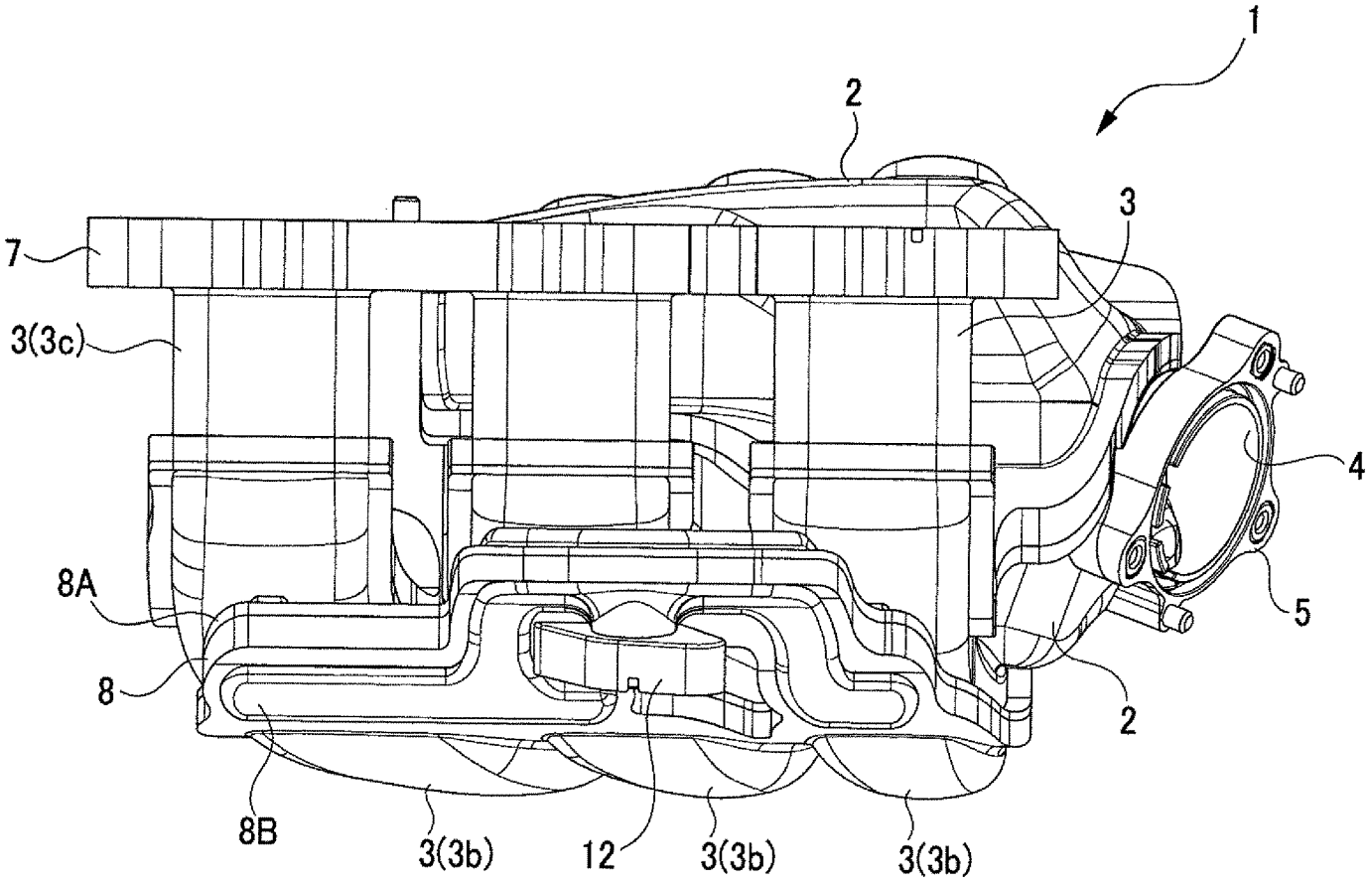
FIG. 5 is a plan view of the intake manifold in the first embodiment.

FIG. 1 is a front view of an intake manifold 1 in the present embodiment and FIG. 2 is a back view of the same. FIG. 3 is a right side view of the intake manifold 1 in the present embodiment and FIG. 4 is a left side view of the same. FIG. 5 is a plan view of the intake manifold 1 in the present embodiment. This intake manifold 1 will be mounted in an engine 10 (see FIG. 8) to introduce intake air into a plurality of cylinders during use. This intake manifold 1 is made of resin and provided with a surge tank 2 and a plurality of branch pipes 3 branching from the surge tank 2. In the present embodiment, the intake manifold 1 includes three branch pipes 3 corresponding to a three-cylinder engine.

As shown in FIGS. 1 to 5, the surge tank 2 is provided with an intake inlet 4 for inflow of intake air into the tank 2. An inlet flange 5 is arranged around the outer circumference of the intake inlet 4. This inlet flange 5 will be connected to an intake pipe and others. Further, the branch pipes 3 are provided, at each downstream end, with intake outlets 6 for outflow of intake air to intake ports 10*a* (see FIG. 8) of an engine 10 (see FIG. 8). An outlet flange 7 is arranged around the outer circumference of the intake outlets 6. This outlet flange 7 will be connected to the engine 10 (see FIG. 8) in correspondence with the intake ports 10*a* (see FIG. 8) of the engine 10. At some point of each of the branch pipes 3, there is provided an auxiliary passage part 8 internally including a gas passage 14 (see FIG. 8) to introduce predetermined auxiliary gas into the branch pipes 3. In the present embodiment, a conceivable one as the auxiliary gas is blow-by gas (PCV gas) which has leaked out of the engine to a crankcase. Another conceivable one as the auxiliary gas is EGR gas which is a part of exhaust gas discharged from the engine and caused to return back to the engine. The auxiliary passage part 8 is placed in a position on top of the branch pipes 3, that is, on an upper side of the intake manifold 1 while the intake manifold 1 is mounted in the engine. As shown in FIGS. 1 to 5, the auxiliary passage part 8 is located on the upper side of the intake manifold 1, in a midstream region 3*b* of each branch pipe 3, to extend obliquely along the inclination of the midstream region 3*b*. As shown in FIG. 1, the auxiliary passage part 8 is provided with a single gas inflow port 11 for inflow of auxiliary gas. An inlet flange 12 is arranged around the outer circumference of the gas inflow port 11.

In the present embodiment, as shown in FIGS. 3 and 4, the intake manifold 1 is made up of a first piece 1A, a second piece 1B, and a third piece 1C which have been made of resin as three separate parts, or shells, by molding and then integrally joined together. In the present embodiment, as one example of a method of joining those pieces, a vibration welding method may be employed.

Figure 6:
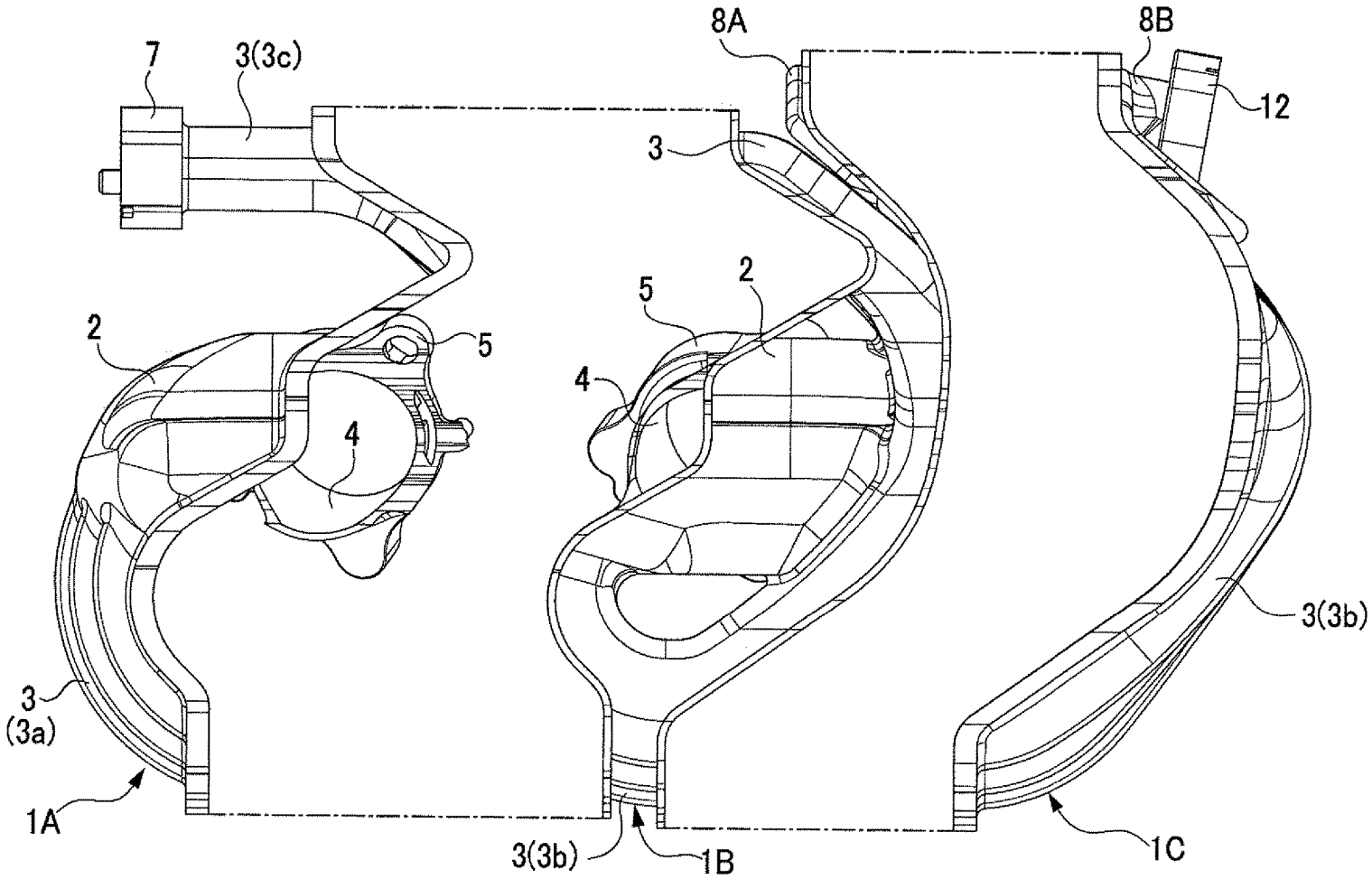
FIG. 6 is an exploded left side view of the intake manifold in the first embodiment.
Figure 7:
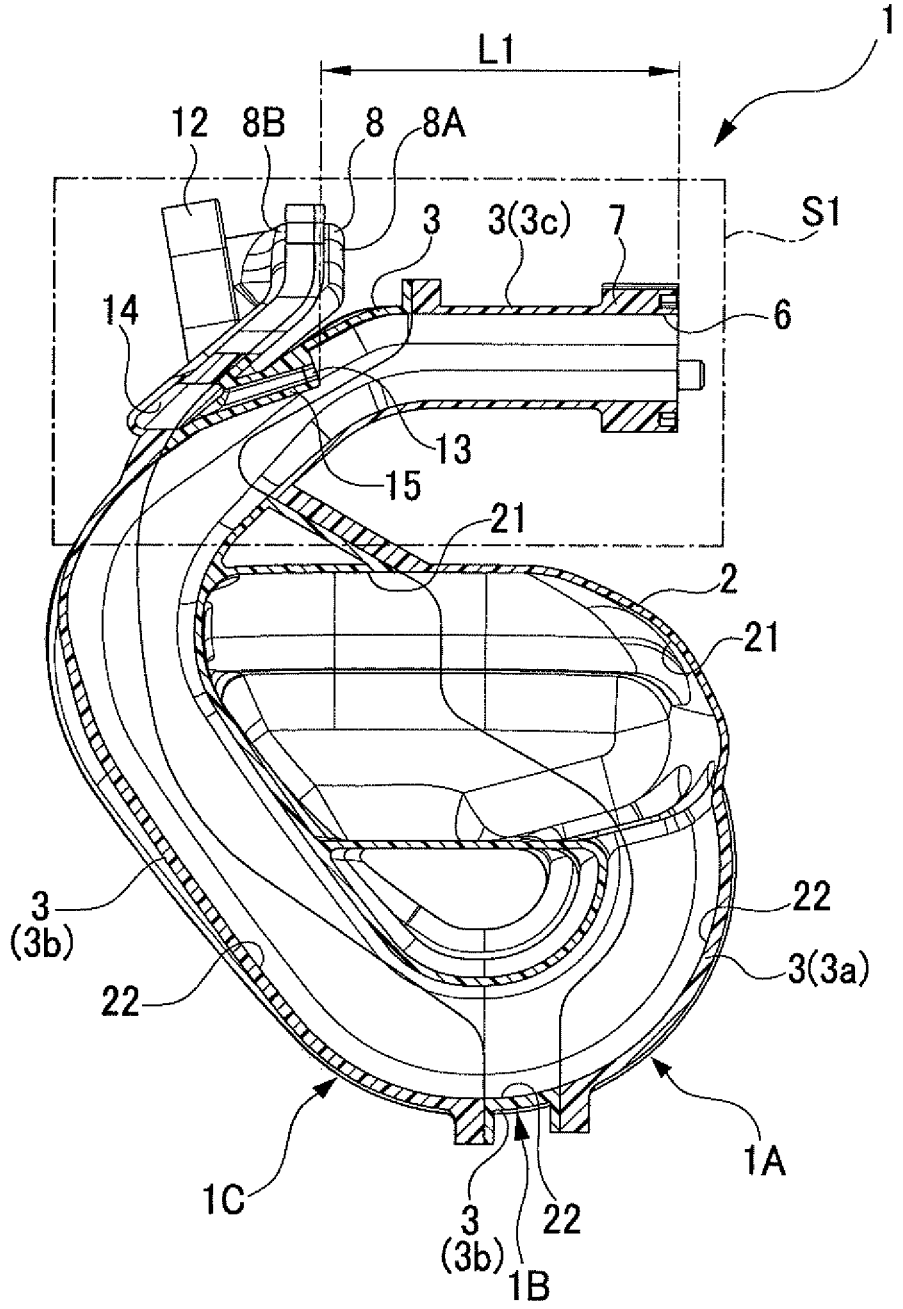
FIG. 7 is a cross sectional view of the intake manifold taken along a line A-A in FIG. 2 in the first embodiment.

FIG. 6 is an exploded left side view of the intake manifold 1. FIG. 7 is a cross sectional view of the intake manifold 1 taken along a line A-A in FIG. 2. As shown in FIGS. 6 and 7, the first piece 1A has a shape constituting the surge tank 2, an upstream region 3*a* and a downstream region 3*c* of each of the branch pipes 3, the plurality of intake outlets 6 and the outlet flange 7, the intake inlet 4, and the inlet flange 5. The second piece 1B has a shape constituting the surge tank 2, the upstream region 3*a* and the midstream region 3*b* of each of the branch pipes 3, the auxiliary passage part 8 (including the gas passage 14, a plurality of gas outflow ports 13, and others which will be described later), the intake inlet 4, and the inlet flange 5. The third piece 1C has a shape constituting the midstream region 3*b* of each of the branch pipes 3 and the auxiliary passage part 8 (including the gas passage 14, the gas inflow port 11, the inlet flange 12, and others which will be described later).

Figure 8:
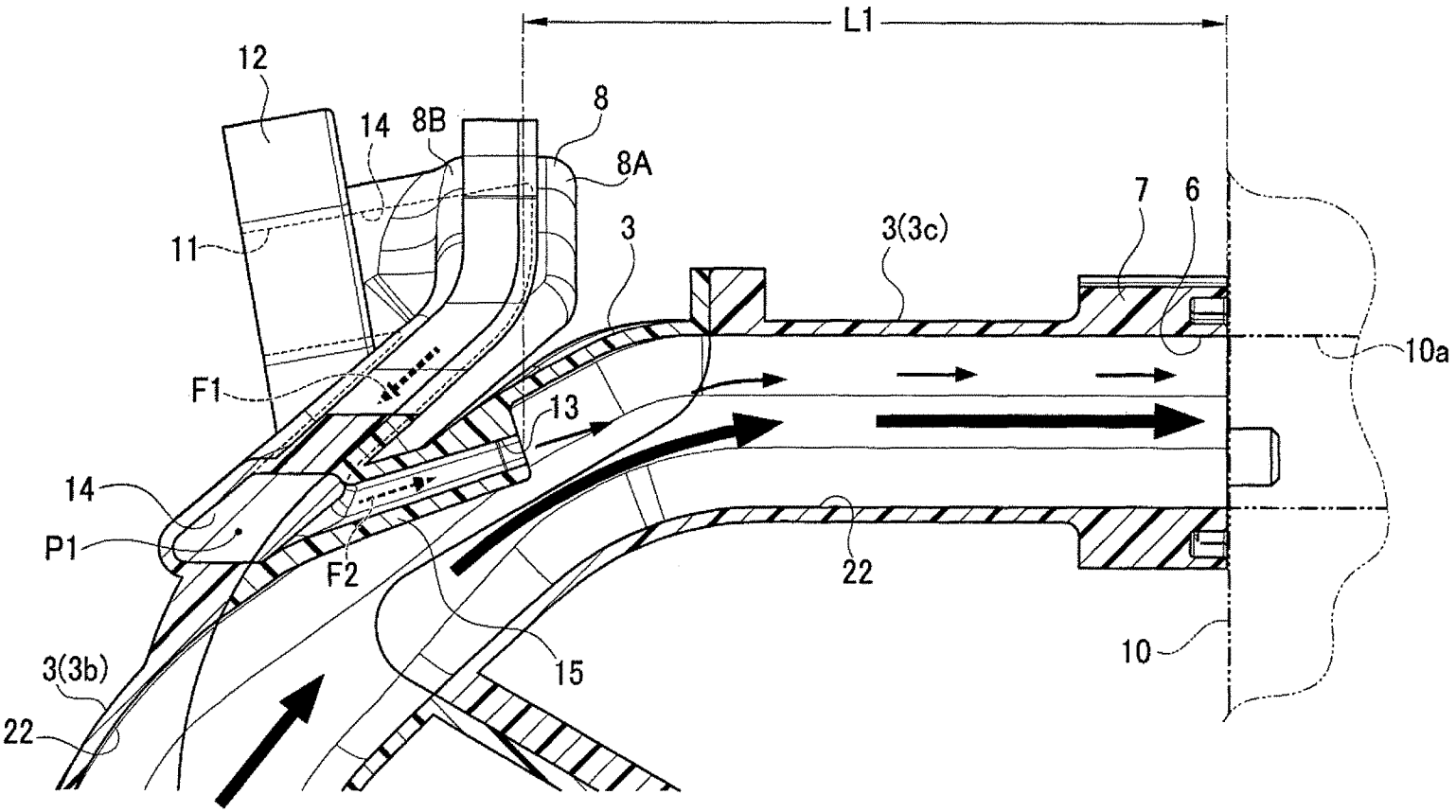
FIG. 8 is an enlarged cross sectional view of a part enclosed by a rectangular chain line in FIG. 7 in the first embodiment.

FIG. 8 is an enlarged cross sectional view of a part enclosed by a rectangular chain line S1 in FIG. 7. As shown in FIG. 8, the intake manifold 1 is disposed so that the intake outlet 6 of each branch pipe 3 is communicated with the corresponding intake port 10*a* when the intake manifold 1 is mounted in the engine 10. As shown in FIGS. 7 and 8, in the auxiliary passage part 8, there are provided the plurality of gas outflow ports 13 opening one in each of the branch pipes 3 and the gas passage 14 extending in a branch form from the gas inflow port 11 to the gas outflow ports 13. In the present embodiment, as shown in FIGS. 7 and 8, each of the gas outflow ports 13 is arranged away from the intake outlet 6 of the corresponding branch pipe 3 by a predetermined passage length L1. In the present embodiment, for one example, this passage length L1 can be set to at least 20% of the total passage length of each branch pipe 3.

Furthermore, as shown FIGS. 7 and 8, in the present embodiment, there is provided a nozzle 15 with a passage having a predetermined length and including a distal end formed with the gas outflow port 13. The nozzle 15 has such a shape that the passage is gradually narrower toward the gas outflow port 13. The nozzle 15 has an orientation to direct a flow, or stream, of auxiliary gas (solid arrows) allowed to flow out from the gas outflow port 13 in a direction along a flow of intake air (thick arrows) in the corresponding branch pipe 3. In other words, the extending direction of the nozzle 15 is set to cause the auxiliary gas emerging from the gas outflow port 13 of the nozzle 15 to flow in almost parallel with the flow of intake air in the corresponding branch pipe 3.

As shown in FIG. 8, furthermore, the gas passage 14 in the auxiliary passage part 8 extends once from the gas inflow port 11 in a direction (indicated by a dashed arrow F1) opposite to the flow of intake air in each branch pipe 3 and turns back at a turn-back portion P1 to further extend in a direction (indicated by a dashed arrow F2) along the flow of intake air.

In the present embodiment, as shown in FIGS. 6 and 7, the gas inflow port 11, the gas outflow ports 13, and the gas passage 14 are made up of two pieces of the plurality of pieces 1A to 1C, that is, the second piece 1B and the third piece 1C. The downstream regions 3*c* of the branch pipes 3 and the intake outlets 6 are made up of the first piece 1A, other than the second piece 1B and the third piece 1C. A part of the surge tank 2, the downstream regions 3*c* of the branch pipes 3, and the intake outlets 6 are integrally made up of a single piece, that is, the first piece 1A.

Figure 9:
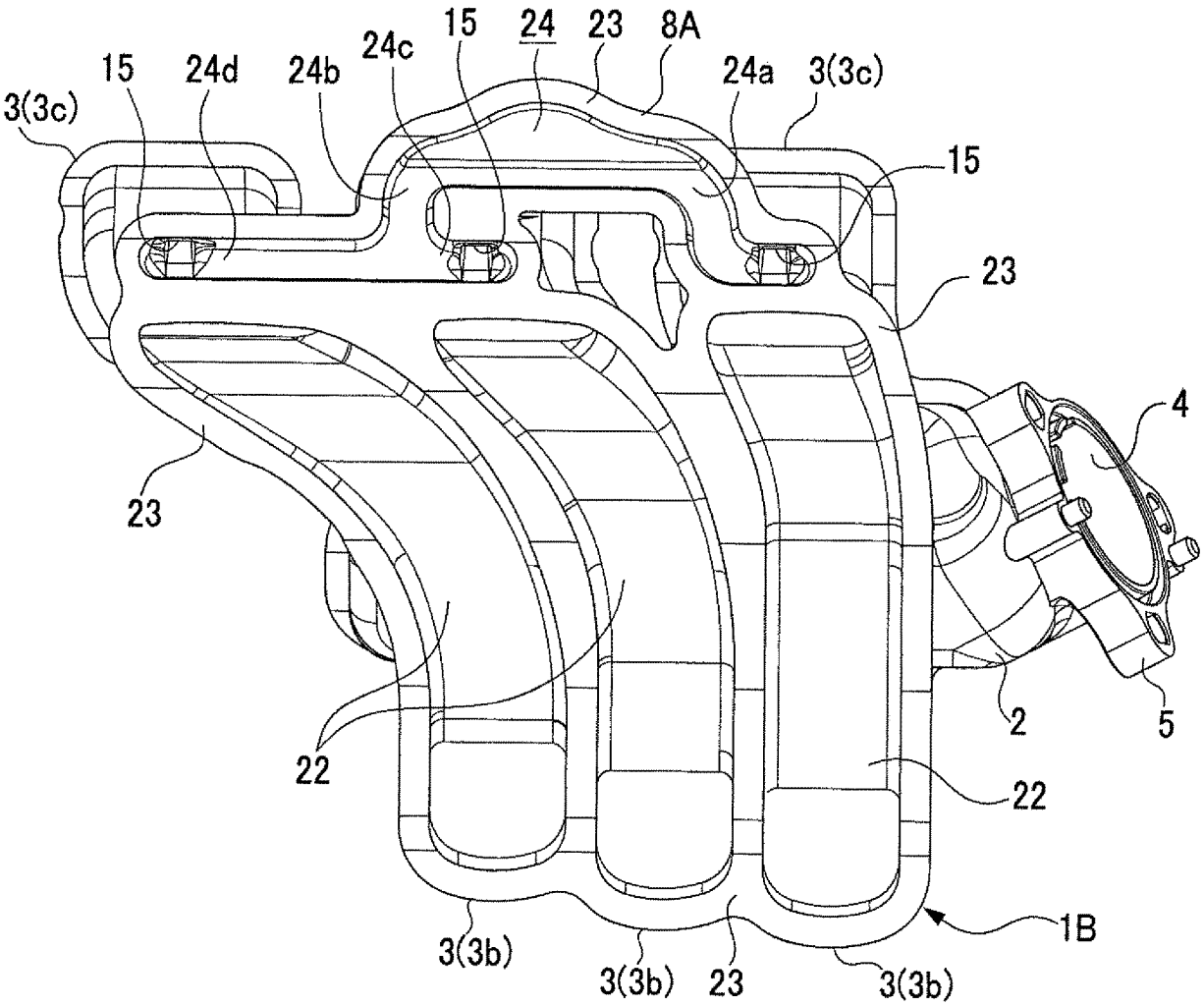
FIG. 9 is a front view of a second piece in the first embodiment.
Figure 10:
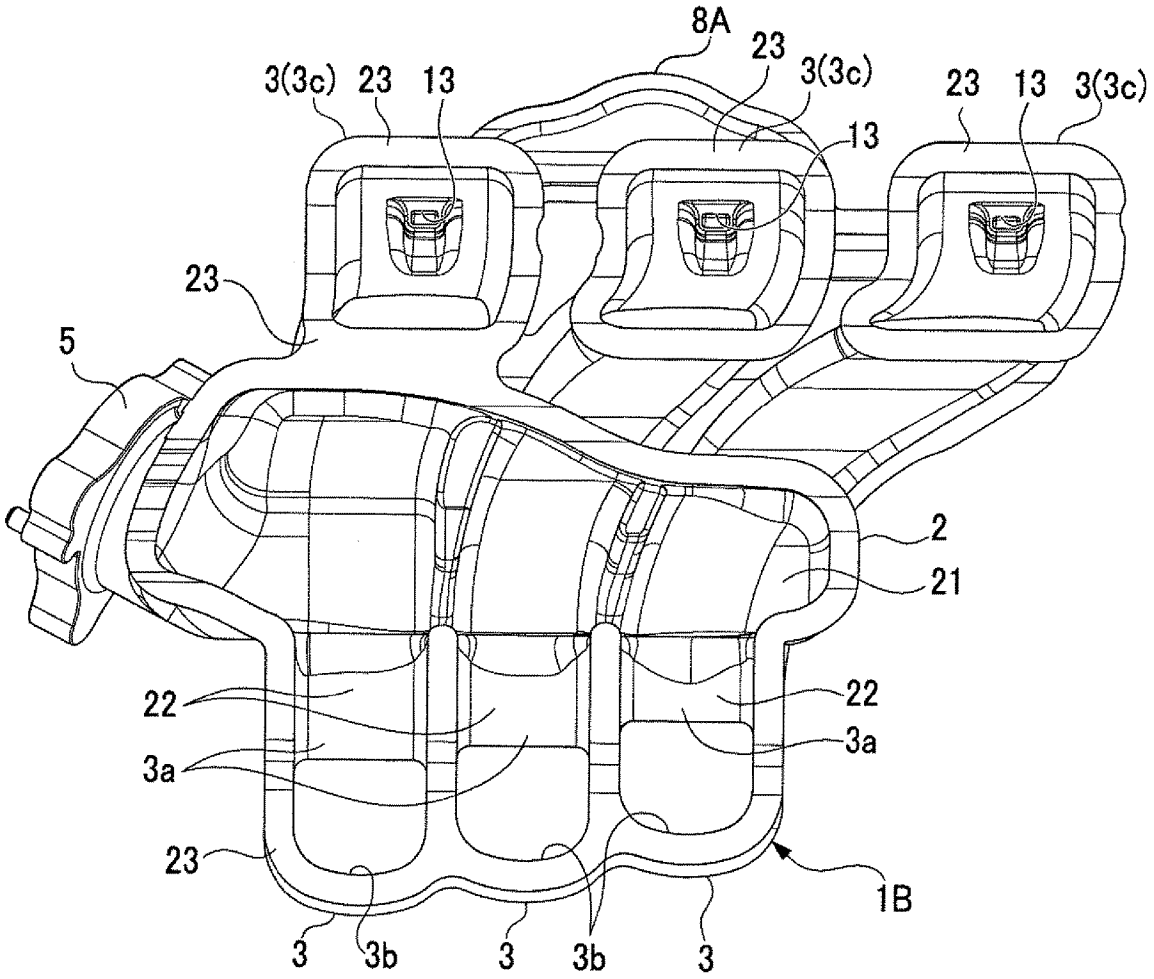
FIG. 10 is a back view of the second piece in the first embodiment.
Figure 11:
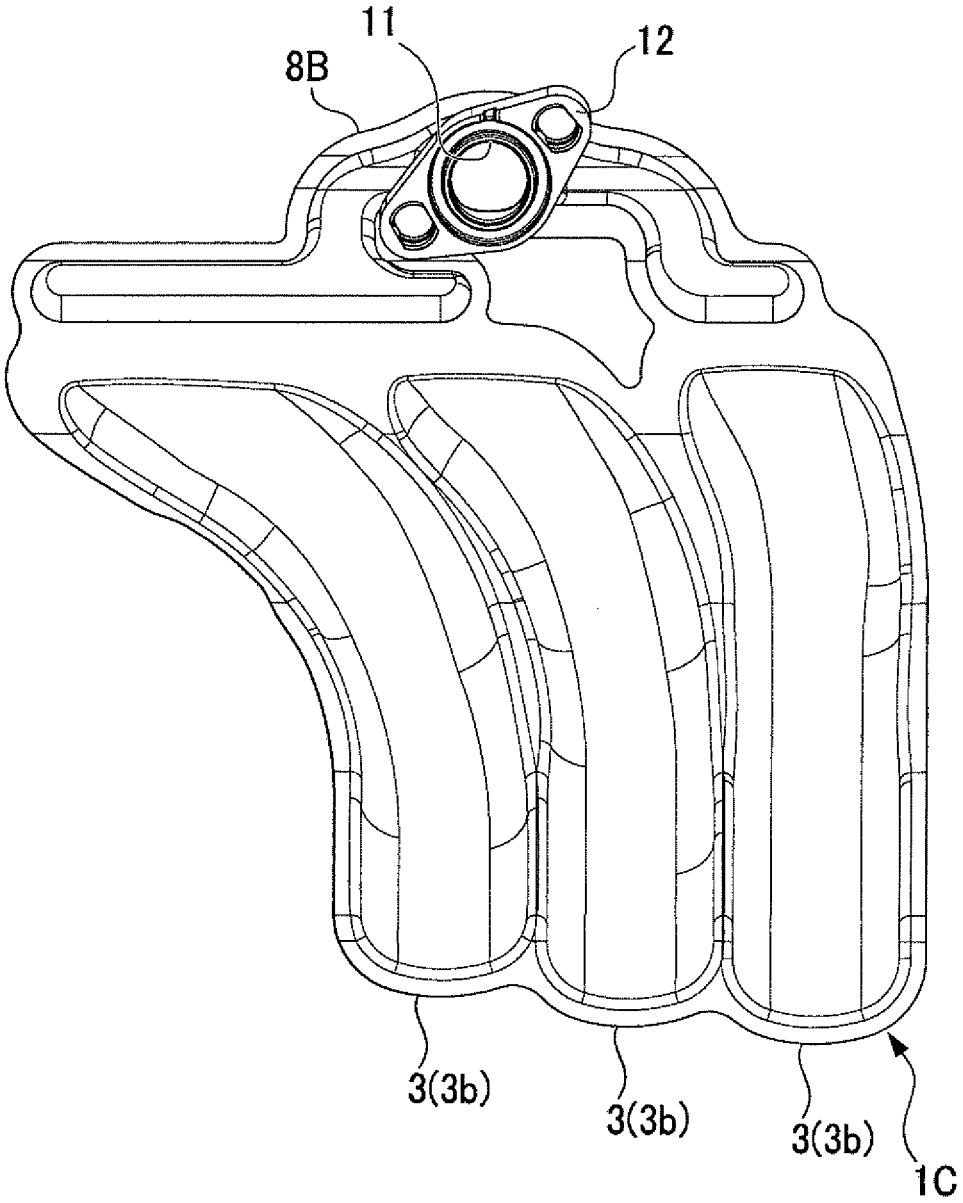
FIG. 11 is a front view of a third piece in the first embodiment.
Figure 12:
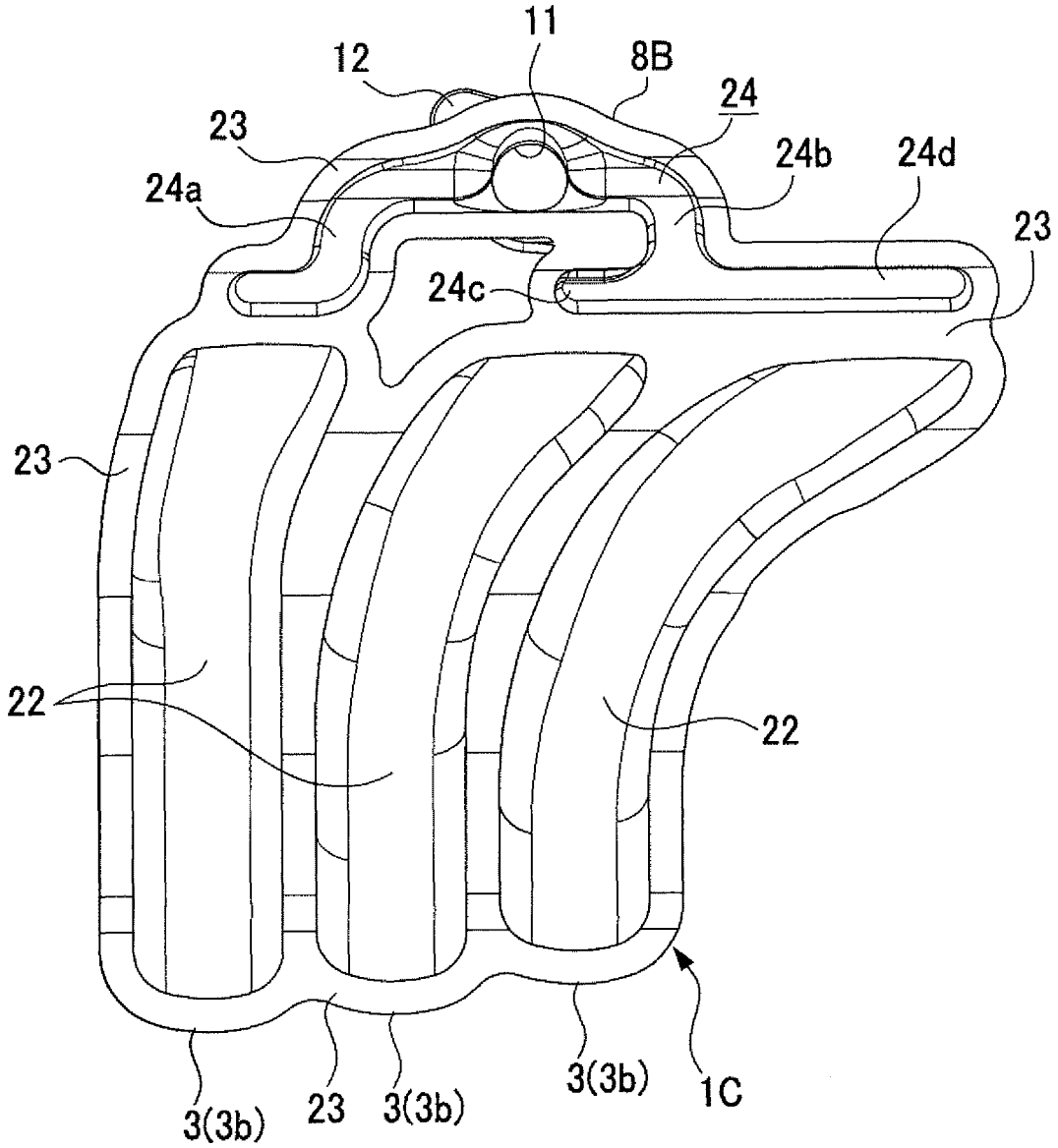
FIG. 12 is a back view of the third piece in the first embodiment.

The configuration of the auxiliary passage part 8 will be described in detail below. FIG. 9 is a front view of the second piece 1B and FIG. 10 is a back view of the same. FIG. 11 is a front view of the third piece 1C and FIG. 12 is a back view of the same. As shown in FIGS. 9 and 10, the second piece 1B includes a recessed portion 21 constituting the surge tank 2 and recessed portions 22 individually constituting the branch pipes 3. These recessed portions 21 and 22 are surrounded by joint margins 23 to connect the adjacent pieces 1A to 1C to each other. As shown in FIGS. 11 and 12, the third piece 1C includes recessed portions 22 constituting the branch pipes 3. Similarly, these recessed portions 22 are surrounded by joint margins 23. The same applies to the first piece 1A (not shown).

As shown in FIG. 9, the second piece 1B includes a first auxiliary-passage subpart 8A constituting the auxiliary passage part 8. As shown in FIG. 12, the third piece 1C includes a second auxiliary-passage subpart 8B constituting the auxiliary passage part 8. Furthermore, each of the auxiliary passage subparts 8A and 8B is formed with a passage groove 24 constituting the gas passage 14. These passage grooves 24 are each divided into two groove portions 24*a* and 24*b* centering on the gas inflow port 11. One groove portion 24*a* of the divided groove 24 is further divided into two groove portions 24*c* and 24*d*. At the end of each of the groove portions 24*a*, 24*c*, and 24*d*, the nozzle 15 including the gas outflow port 13 is formed. Similarly, each of the passage grooves 24 is surrounded by joint margins 23. The auxiliary passage subpart 8A of the second piece 1B and the auxiliary passage subpart 8B of the third piece 1C are connected to each other, thus constituting the auxiliary passage part 8 including the gas passage 14 and others. In the present embodiment, the gas passage 14 is designed so that each portion of the gas passage 14 has a passage cross sectional area that makes pressure loss equal between the portions of the gas passage 14 from the gas inflow port 11 to each gas outflow port 13.

According to the intake manifold 1 configured as above in the present embodiment, since the intake manifold 1 is made up of the separate three pieces 1A to 1C, these pieces 1A to 1C are individually easily fabricated. This enables easy manufacturing of the intake manifold 1 inherently having a complicated shape. The three gas outflow ports 13 opening one in each of the branch pipes 3 are arranged away from the intake outlet 6 of the branch pipe 3 provided with the corresponding gas outflow port 13 by a predetermined passage length L1. Accordingly, while the intake manifold 1 is mounted in the engine 10, each gas outflow port 13 is located away from each intake port 10*a* of the engine 10 by the predetermined passage length L1. Therefore, even when the intake manifold 1 includes the gas passage 14 for auxiliary gas that is communicated with each branch pipe 3 when the intake manifold 1 is mounted in the engine 10, the intake manifold 1 can make the cylinders of the engine 10 less likely to communicate with each other, thereby enhancing the intake flow characteristics in each branch pipe 3 and preventing deterioration of engine performance.

According to the configuration of the present embodiment, the gas inflow port 11, the three gas outflow ports 13, and the gas passage 14 are constituted of the second piece 1B and the third piece 1C, while the remaining first piece 1A constitutes the downstream regions 3*c* of the three branch pipes 3 and the three intake outlets 6. Thus, the three gas outflow ports 13 and the gas passage 14 are made up of different pieces from the first piece 1A that constitutes the downstream regions 3*c* of the three branch pipes 3 and the three intake outlets 6. This allows easy fabrication of each of the pieces 1A to 1C. Consequently, for the intake manifold 1 made up of the three pieces 1A to 1C, the passage length L1 from each gas outflow port 13 to each intake outlet 6 can be easily designed to be enough long.

According to the configuration of the present embodiment, the gas outflow port 13 is provided at the distal end of the nozzle 15, thereby enhancing a flow velocity of auxiliary gas emerging from the gas outflow port 13 into the branch pipe 3. Further, the nozzle 15 has the orientation to direct the flow of auxiliary gas emerging from the gas outflow port 13 in a direction along the flow of intake air in the branch pipe 3. This can achieve smooth flow of the auxiliary gas together with the intake air into the intake port 6. This configuration can smoothly introduce the auxiliary gas together with the intake air into each intake port 10*a* of the engine 10 without causing the auxiliary gas to block or disturb the flow of intake air.

According to the configuration of the present embodiment, the auxiliary passage part 8 including the gas passage 14 is provided in the intake manifold 1 to allow the auxiliary gas entering through the gas inflow port 11 to flow once in the opposite direction (indicated by the dashed arrow F1) to the flow of intake air in each branch pipe 3 and turn back at the turn-back portion P1 to further flow in the parallel direction (indicated by the dashed arrow F2) with the flow of intake air in each branch pipe 3. Accordingly, this configuration enables the auxiliary passage part 8, which includes the gas passage 14 extending from the gas inflow port 11 to the turn-back portion P1, to be provided in a position close to the branch pipes 3 and in addition enables the auxiliary gas to eventually flow along the flow of intake air in each branch pipe 3. Thus, the intake manifold 1 can be provided with the auxiliary passage part 8 including the gas passage 14 and others in a relatively compact structure without causing auxiliary gas to block or disturb a flow of intake air and without excessively protruding outward from the branch pipe 3. As a result of this design, the auxiliary passage part 8 is less likely to cause restriction on placement for surrounding parts or components around the engine.

According to the configuration of the present embodiment, a part of the surge tank 2 and the downstream regions 3*c* of the three branch pipes 3 and the three intake outlets 6 are integrally constituted of the single piece 1A. Thus, while the intake manifold 1 is mounted in the engine 10, the rigidity of the intake manifold 1 can be enhanced by the first piece 1A. This can reduce vibration of the intake manifold 1 while it is mounted in the engine 10 and thus can increase the pressure resistance of the intake manifold 1.

According to the configuration of the present embodiment, it is arranged to make the pressure loss equal between the portions of the gas passage 14 from the gas inflow port 11 to each gas outflow port 13. Thus, uniform outflow of auxiliary gas from each gas outflow port 13 to each branch pipe 3 can be achieved. This makes it possible to uniformly distribute the auxiliary gas from the intake manifold 1 to the intake ports 10*a* of the engine 10.

According to the configuration of the present embodiment, the auxiliary passage part 8 internally including the gas passage 14 is constituted integrally with the intake manifold 1. This configuration needs no additional piping for the gas passage 14 and others and thus can simplify the surrounding structure of the engine.

Second Embodiment

A second embodiment embodying an intake manifold according to the present disclosure will be described in detail below referring to the accompanying drawings.

In the following description, identical or similar parts to those in the first embodiment are given the same reference signs and their details are omitted. Thus, differences from the first embodiment are mainly explained below.

Figure 13:
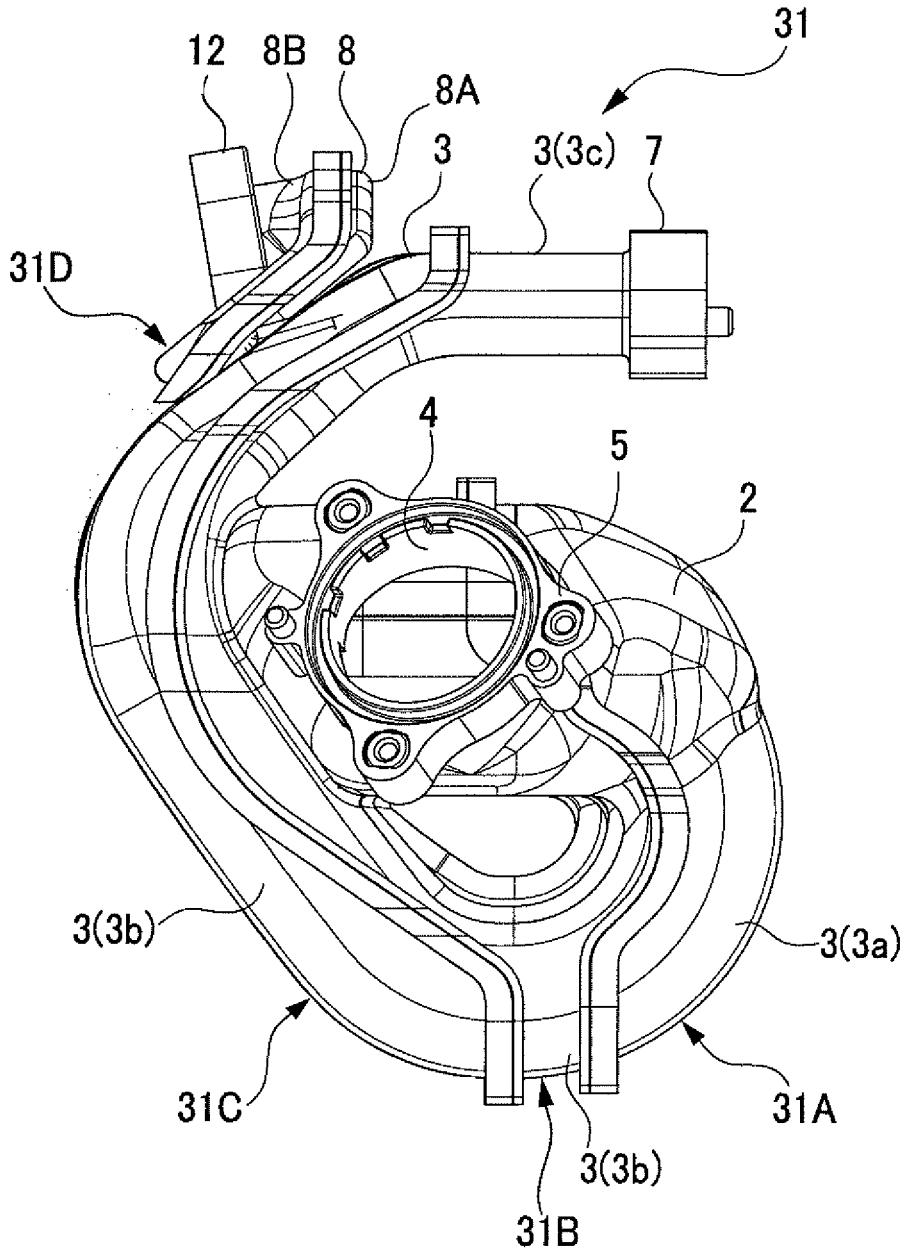
FIG. 13 is a right side view of an intake manifold in a second embodiment.
Figure 14:
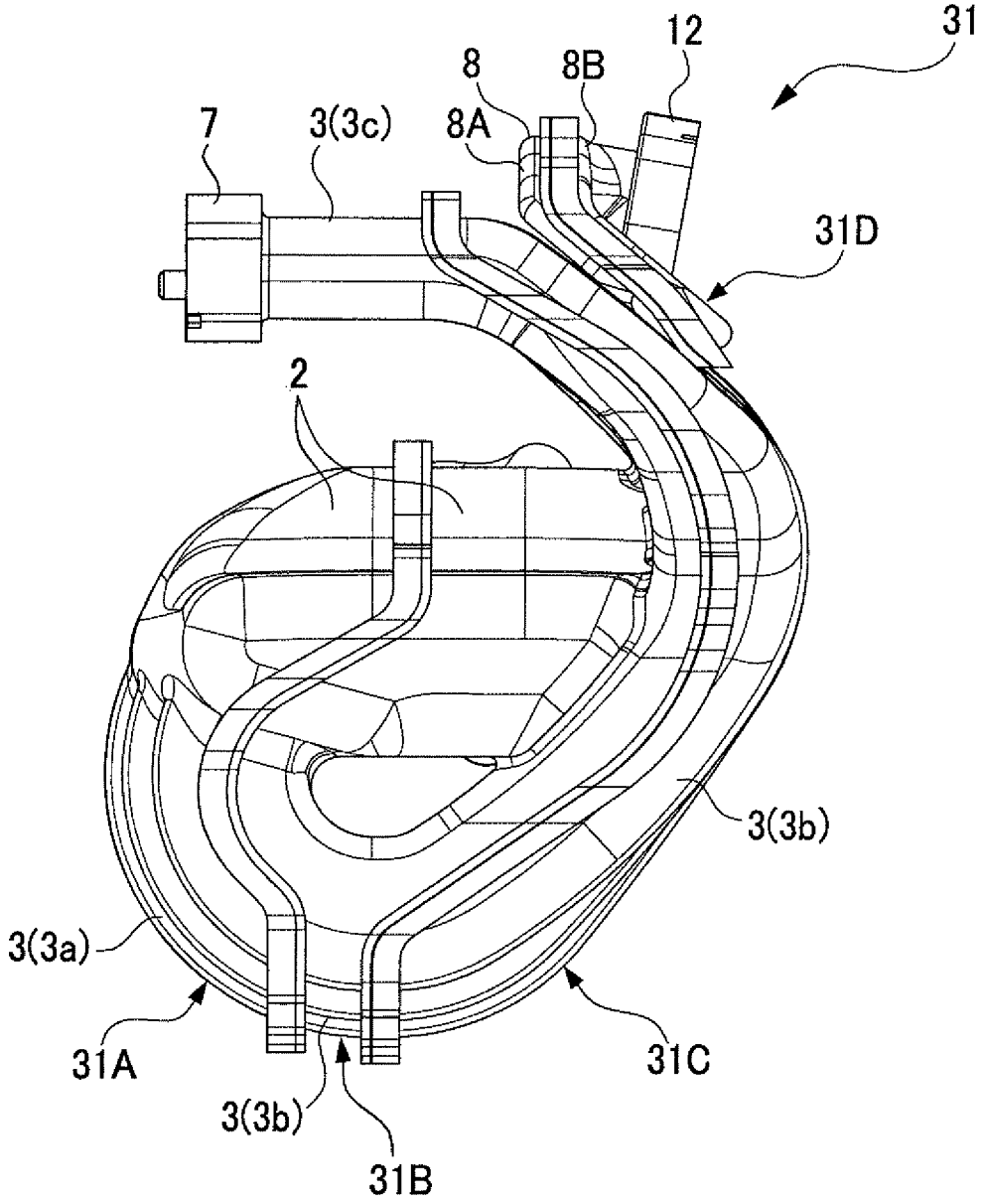
FIG. 14 is a left side view of the intake manifold in the second embodiment.
Figure 15:
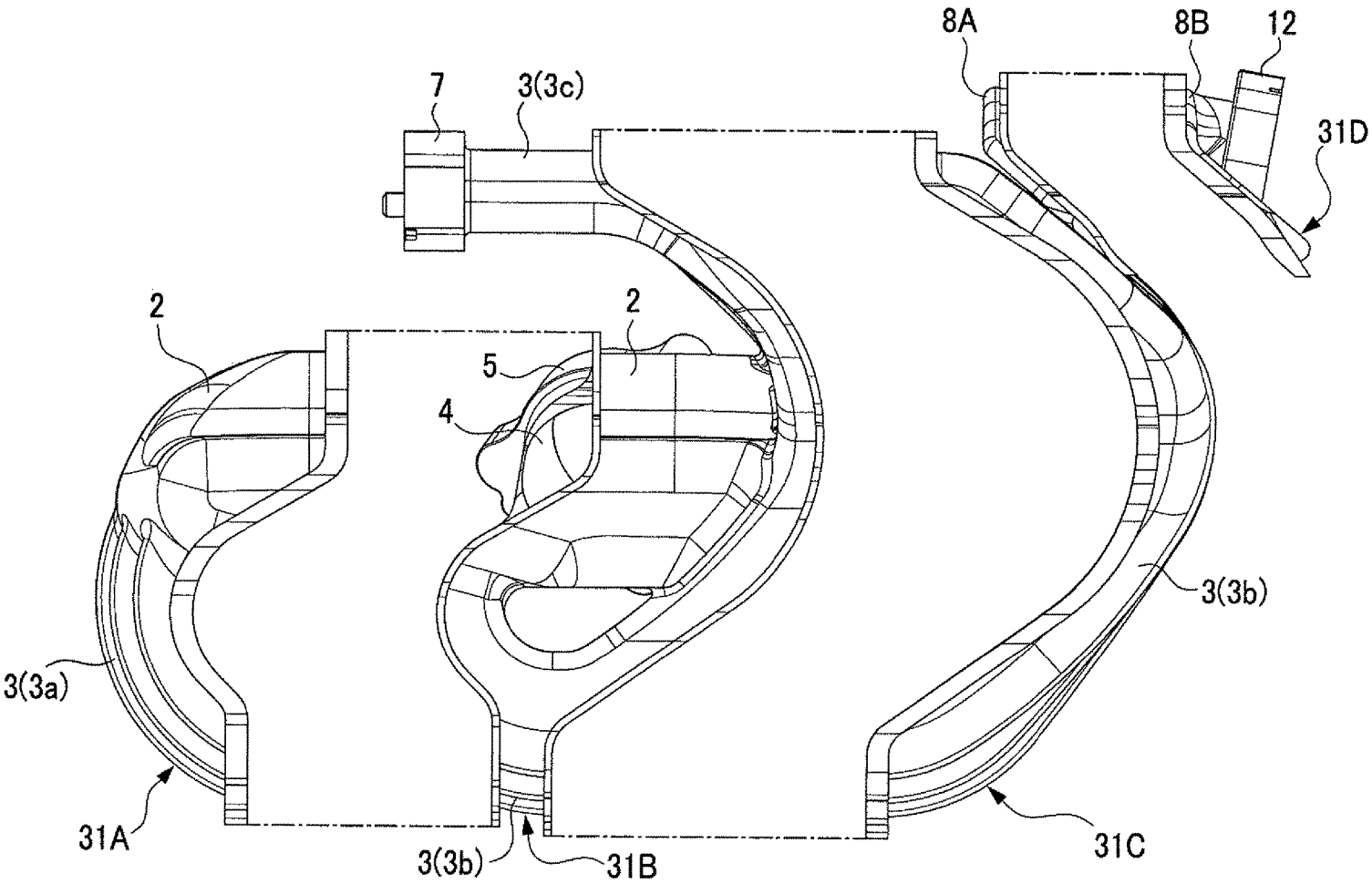
FIG. 15 is an exploded left side view of the intake manifold in the second embodiment.
Figure 16:
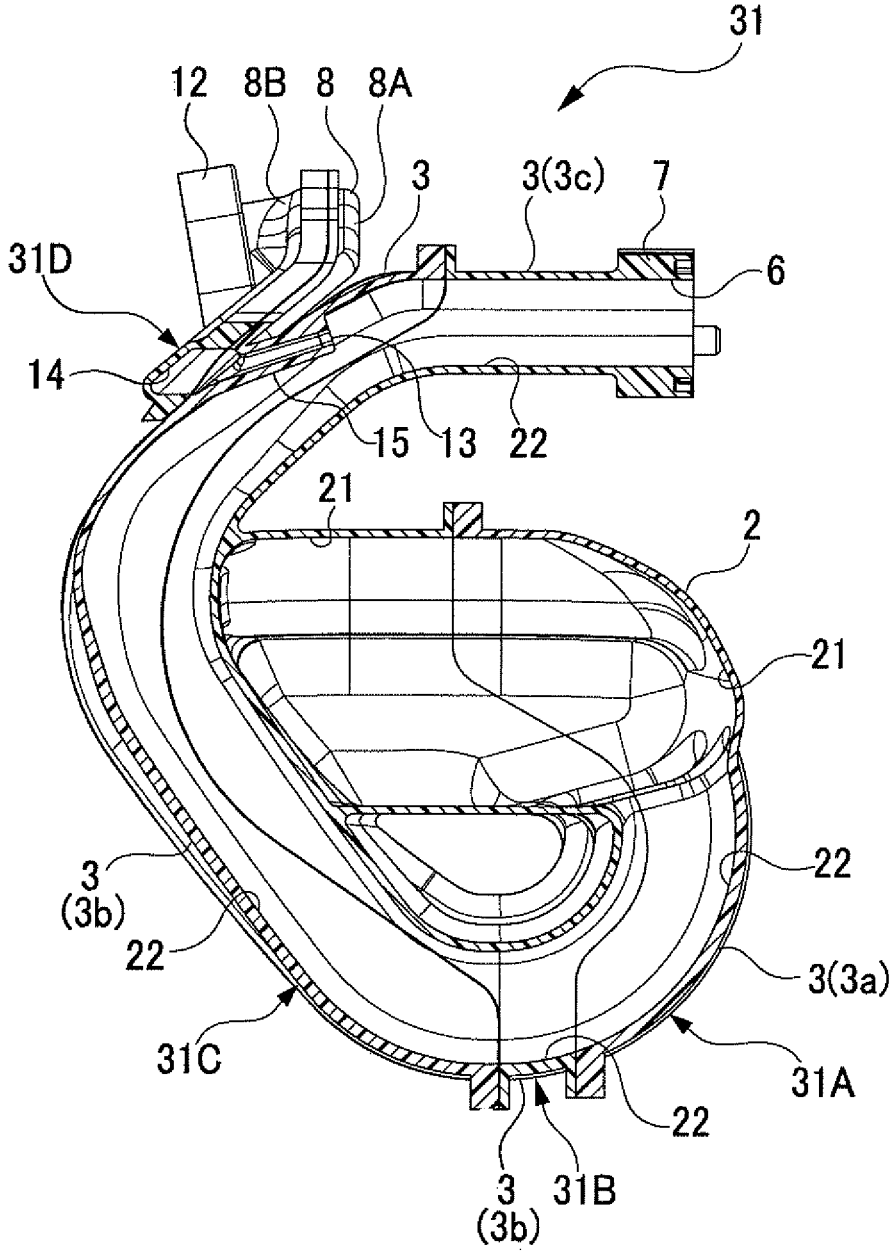
FIG. 16 is a cross sectional view of the intake manifold in the second embodiment, corresponding to FIG. 7.

This second embodiment differs from the first embodiment in that an intake manifold is made up of four pieces. FIG. 13 is a right side view of an intake manifold 31 in the present embodiment and FIG. 14 is a left side view of the same. FIG. 15 is an exploded left side view of the intake manifold 31. FIG. 16 is a cross sectional view of the intake manifold 31, corresponding to FIG. 7. As shown in FIGS. 13 to 16, the intake manifold 31 in the present embodiment has substantially the same outer configuration as that of the intake manifold 1 in the first embodiment. In contrast, the intake manifold 31 in the present embodiment is made up of four pieces 31A to 31D, that is, a first piece 31A, a second piece 31B, a third piece 31C, and a fourth piece 31D. The first piece 31A constitutes the surge tank 2 and the upstream regions 3*a* of the three branch pipes 3. The second piece 31B constitutes the surge tank 2, the intake inlet 4, the inlet flange 5, the upstream region 3*a*, midstream region 3*b*, and downstream region 3*c* of each of the three branch pipes 3, the three intake outlets 6, and the outlet flange 7. The third piece 31C constitutes the midstream regions 3*b* of each of the three branch pipes 3, the gas passage 14, and the three nozzles 15 individually including the gas outflow ports 13. The fourth piece 31D constitutes the gas passage 14, the gas inflow port 11, and the inlet flange 12.

The present embodiment further differs from the first embodiment in the following configurations. That is, the intake manifold 31 is made up of the four pieces 31A to 31D, so that the second piece 31B constitutes the surge tank 2 and the upstream region 3*a*, midstream region 3*b*, and downstream region 3*c* of each of the three branch pipes 3. In the present embodiment, accordingly, the second piece 31B ensures high rigidity of the intake manifold 31. This configuration can thus reduce vibration of the intake manifold 31 when mounted in the engine and hence can improve the pressure performance of the intake manifold 31.

Figure 17:
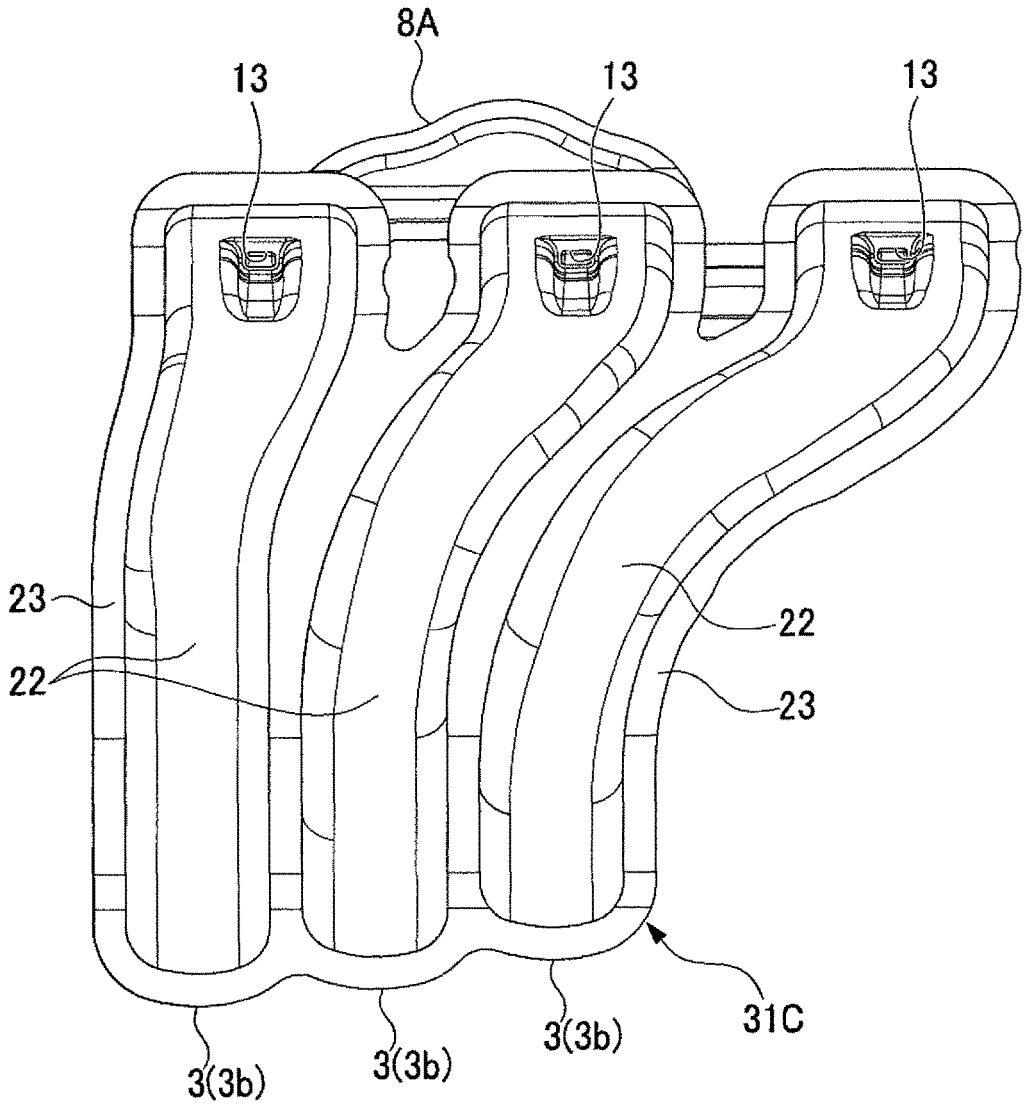
FIG. 17 is a front view of a third piece in the second embodiment.
Figure 18:
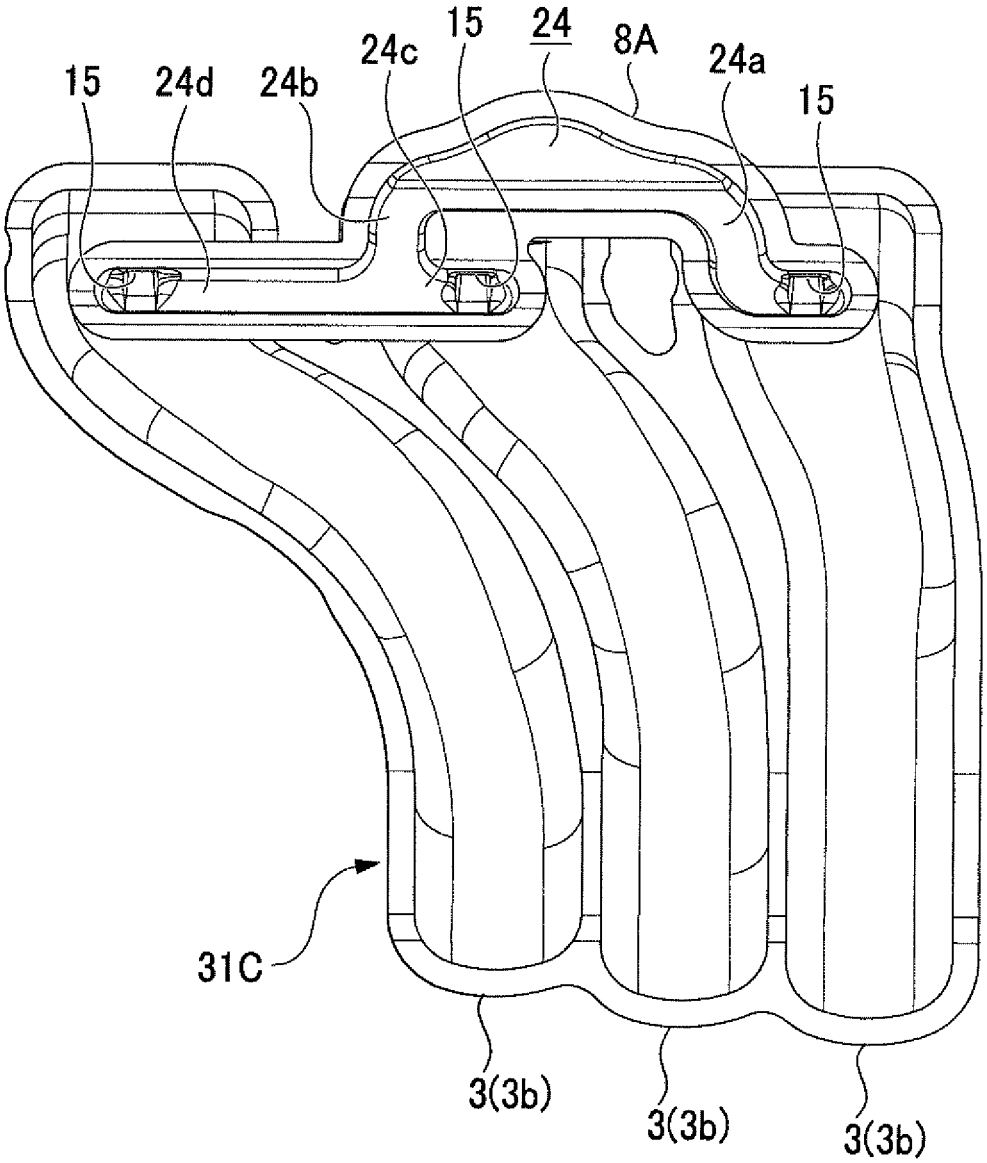
FIG. 18 is a back view of the third piece in the second embodiment.
Figure 19:
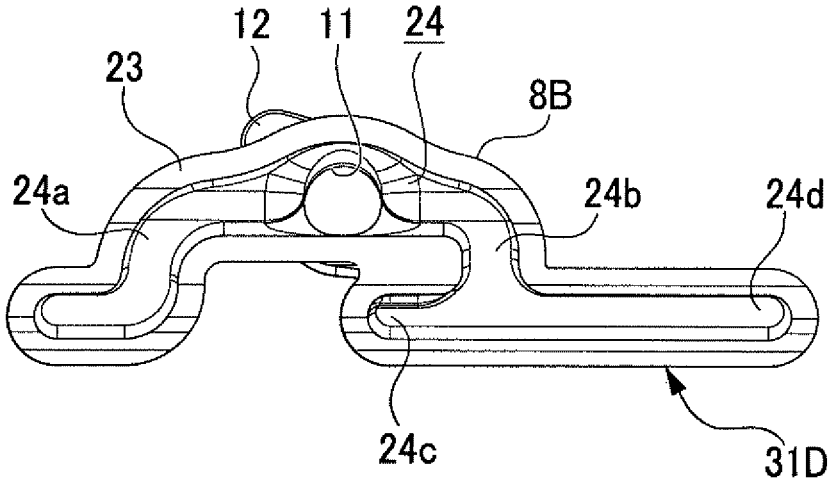
FIG. 19 is a front view of a fourth piece in the second embodiment.
Figure 20:
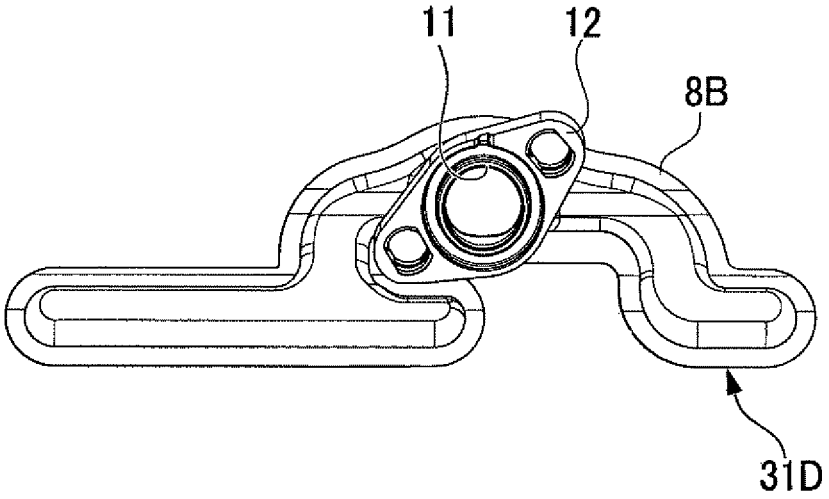
FIG. 20 is a back view of the fourth piece in the second embodiment.
Figure 21:
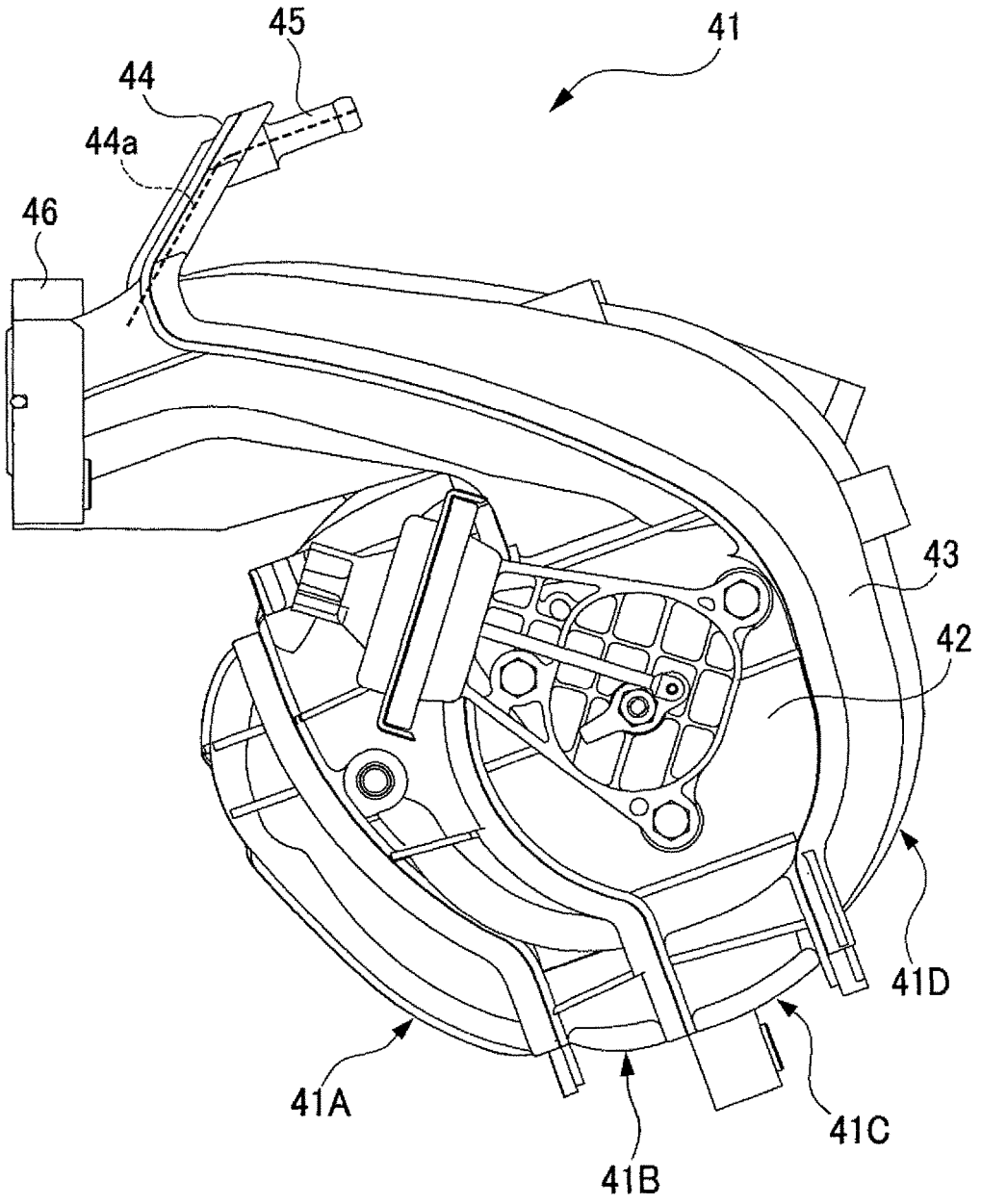
FIG. 21 is a side view of an intake manifold in a related art.

In the present embodiment, moreover, the third piece 31C and the fourth piece 31D form the auxiliary passage part 8. FIG. 17 is a front view of the third piece 31C and FIG. 18 is a back view of the same. FIG. 19 is a front view of the fourth piece 31D and FIG. 20 is a back view of the same. As shown in FIG. 17, the third piece 31C includes recessed portions 22 individually constituting the branch pipes 3. Those recessed portions 22 are surrounded by joint margins 23 to connect the adjacent pieces 31A to 31D to each other. The same applies to the first piece 31A and the second piece 31B (not shown).

As shown in FIG. 18, the third piece 31C includes the first auxiliary passage subpart 8A constituting the auxiliary passage part 8. As shown in FIG. 19, the fourth piece 31D includes only the second auxiliary passage subpart 8B constituting the auxiliary passage part 8. Each of the auxiliary passage subparts 8A and 8B is formed with the passage groove 24 constituting the gas passage 14 as shown in FIGS. 18 and 19. The passage groove 24 is divided into two groove portions 24*a* and 24*b* centering on the gas inflow port 11. One groove portion 24*a* of the divided groove is further divided into two groove portions 24*c* and 24*d*. At an end of each of the groove portions 24*a*, 24*c*, and 24*d*, the nozzle 15 including the gas outflow port 13 is formed. Those passage grooves 24 are surrounded by joint margins 23. The auxiliary passage subpart 8A of the third piece 31C and the auxiliary passage subpart 8B of the fourth piece 31D are connected to each other, thereby constituting the auxiliary passage part 8 including the gas passage 14 and others. In the present embodiment, the gas passage 14 is designed so that each portion of the gas passage 14 has a passage cross sectional area that makes pressure loss equal between the portions of the gas passage 14 from the gas inflow port 11 to each gas outflow port 13.

In the present embodiment, different in structure from the first embodiment as described above, the fourth piece 31D has only to include the auxiliary passage subpart 8B. This allows easy fabrication of the fourth piece 31D. Further, since the fourth piece 31D is separately provided, the third piece 31C can have a simplified shape by just that much. In addition, the first piece 31A also has a simplified shape. Therefore, the first piece 31A, the second piece 31B, and the fourth piece 31D can be relatively reduced in size, resulting in a simplified shape. Other operations and advantageous effects in the present embodiment are substantially the same as those of the intake manifold 1 in the first embodiment.

The present disclosure is not limited to the foregoing embodiments and may be embodied in other specific forms without departing from the essential characteristics thereof.

Each of the aforementioned embodiments exemplifies the present disclosure by the intake manifold 1 or 31 including the three branch pipes 3. As an alternative, the number of branch pipes may be set to any number other than three.

In each of the aforementioned embodiments, the number of pieces 1A to 1C or 31A to 31D is three or four. As an alternative, the number of pieces may be set to any number other than three or four.

INDUSTRIAL APPLICABILITY

The present disclosure is utilizable as a constituent part of an intake system in various types of engines.

REFERENCE SIGNS LIST

1 Intake manifold
1A First piece
1B Second piece
1C Third piece
2 Surge tank
3 Branch pipe
3*a* Upstream region
3*b* Midstream region
3*c* Downstream region
4 Intake inlet
6 Intake outlet
8 Auxiliary passage section
8A First auxiliary passage subpart
8B Second auxiliary passage subpart
10 Engine
10*a* Intake port
11 Gas inflow port
13 Gas outflow port
14 Gas passage
15 Nozzle
31 Intake manifold
31A First piece 31B Second piece
31C Third piece
31D Fourth piece
L1 Passage length
P1 Turn-around portion

What is claimed is:

1. An intake manifold comprising:
a surge tank; and
a plurality of branch pipes each branching from the surge tank,
the intake manifold being made up of three separate pieces,
each of the branch pipes being provided with an intake outlet for outflow of intake air to each of intake ports of an engine,
wherein the intake manifold further comprises:
a single gas inflow port for inflow of auxiliary gas;
a plurality of gas outflow ports opening one in each of the branch pipes; and
a gas passage extending in a branch form from the gas inflow port to each of the gas outflow ports,
the plurality of branch pipes are made up of the three pieces and the gas passage is made up of two pieces of the three pieces, and
each of the gas outflow ports is provided away from the intake outlet of the corresponding branch pipe by a predetermined passage length.

2. The intake manifold according to claim 1, wherein the gas inflow port and the plurality of gas outflow ports are made up of two pieces of the three pieces, and a downstream region of each of the plurality of branch pipes, and the plurality of intake outlets are made up of a piece of the three pieces other than the two pieces.

3. The intake manifold according to claim 1, further comprising a plurality of nozzles including, at distal ends, the gas outflow ports,
wherein the nozzles each have an orientation to direct a flow of auxiliary gas allowed to flow out from the corresponding gas outflow ports in a direction along a flow of the intake air in the corresponding branch pipes.

4. The intake manifold according to claim 2, further comprising a plurality of nozzles including, at distal ends, the gas outflow ports,
wherein the nozzles each have an orientation to direct a flow of auxiliary gas allowed to flow out from the corresponding gas outflow ports in a direction along a flow of the intake air in the corresponding branch pipes.

5. The intake manifold according to claim 1, wherein the gas passage extends once from the gas inflow port in a direction opposite to a flow of the intake air in each of the branch pipes and turns back at a turn-back portion to further extend in a direction along the flow of the intake air.

6. The intake manifold according to claim 2, wherein the gas passage extends once from the gas inflow port in a direction opposite to a flow of the intake air in each of the branch pipes and turns back at a turn-back portion to further extend in a direction along the flow of the intake air.

7. The intake manifold according to claim 3, wherein the gas passage extends once from the gas inflow port in a direction opposite to a flow of the intake air in each of the branch pipes and turns back at a turn-back portion to further extend in a direction along the flow of the intake air.

8. The intake manifold according to claim 1, wherein a part of the surge tank, a downstream region of each of the plurality of branch pipes, and the plurality of intake outlets are integrally made up of a single piece.

9. The intake manifold according to claim 2, wherein a part of the surge tank, a downstream region of each of the plurality of branch pipes, and the plurality of intake outlets are integrally made up of a single piece.

10. The intake manifold according to claim 3, wherein a part of the surge tank, a downstream region of each of the plurality of branch pipes, and the plurality of intake outlets are integrally made up of a single piece.

11. The intake manifold according to claim 4, wherein a part of the surge tank, a downstream region of each of the plurality of branch pipes, and the plurality of intake outlets are integrally made up of a single piece.

* * * * *